US011156404B2

(12) United States Patent
Park et al.

(10) Patent No.: US 11,156,404 B2
(45) Date of Patent: Oct. 26, 2021

(54) SHELL-AND-TUBE HEAT EXCHANGER

(71) Applicant: KYUNGDONG NAVIEN CO., LTD., Gyeonggi-do (KR)

(72) Inventors: Jun Kyu Park, Seoul (KR); Sung Jun Ahn, Seoul (KR); Hyun Muk Lim, Seoul (KR)

(73) Assignee: KYUNGDONG NAVIEN CO., LTD.

( * ) Notice: Subject to any disclaimer, the term of this patent is extended or adjusted under 35 U.S.C. 154(b) by 0 days.

(21) Appl. No.: 16/651,204

(22) PCT Filed: Sep. 20, 2018

(86) PCT No.: PCT/KR2018/011154
§ 371 (c)(1),
(2) Date: Mar. 26, 2020

(87) PCT Pub. No.: WO2019/066388
PCT Pub. Date: Apr. 4, 2019

(65) Prior Publication Data

US 2020/0292238 A1 Sep. 17, 2020

(30) Foreign Application Priority Data

Sep. 29, 2017 (KR) ..... 10-2017-0127204

(51) Int. Cl.
*F28F 3/00* (2006.01)
*F28D 7/10* (2006.01)
(Continued)

(52) U.S. Cl.
CPC ..... *F28D 7/10* (2013.01); *F28F 13/06* (2013.01); *F24H 9/0015* (2013.01)

(58) Field of Classification Search
CPC ..... F28D 7/10; F28F 13/06; F24H 9/0015
(Continued)

(56) References Cited

U.S. PATENT DOCUMENTS 4,579,086 A 4/1986 Maton
5,653,282 A 8/1997 Hackemesser et al.
(Continued)

FOREIGN PATENT DOCUMENTS

CN 1823221 A1 8/2006
CN 101586920 A 11/2009
(Continued)

*Primary Examiner* — Davis D Hwu
(74) *Attorney, Agent, or Firm* — Johnson & Martin, P.A.; James David Johnson

(57) ABSTRACT

A shell-and-tube heat exchanger according to the present invention comprises: an outer barrel having a cavity provided therein such that heating water flows along the same; a lower tube plate that covers an opening near one end of the outer barrel; an upper tube plate that covers an opening near the other end of the outer barrel, the upper tube plate providing an inner space in which a heat source is positioned; a plurality of flues for guiding combustion gas from the upper tube plate to the outside of the lower tube plate; and a main diaphragm arranged across a reference direction between the lower tube plate and the upper tube plate, a plurality of through-holes being formed in the main diaphragm such that the flues penetrate the same, wherein at least some of the through-holes constitute a large-width through-hole (single hole) that at least two of the flues penetrate together.

11 Claims, 13 Drawing Sheets

(51) Int. Cl.
*F28F 13/06* (2006.01)
*F24H 9/00* (2006.01)

(58) Field of Classification Search
USPC ..... 165/166
See application file for complete search history.

(56) References Cited

U.S. PATENT DOCUMENTS

| | | | | |
|---|---|---|---|---|
| 8,720,387 | B2 | 5/2014 | Pacholski | |
| 10,386,120 | B2 | 8/2019 | Rizzi | |
| 2006/0231243 | A1 | 10/2006 | Sugihara et al. | |
| 2011/0150440 | A1* | 6/2011 | Lord | F24H 9/0021 392/486 |
| 2017/0045310 | A1 | 2/2017 | Choi | |
| 2017/0205147 | A1 | 7/2017 | Rizzi | |
| 2020/0300559 | A1* | 9/2020 | Wang | F28D 7/0083 |

FOREIGN PATENT DOCUMENTS

| | | | |
|---|---|---|---|
| CN | 204923965 | U | 12/2015 |
| EP | 1683956 | A1 | 7/2006 |
| EP | 3029407 | A1 | 6/2016 |
| JP | H09101001 | A | 4/1997 |
| JP | 3105882 | B2 | 9/2000 |
| KR | 10-1779936 | B1 | 9/2017 |
| RU | 2153643 | C1 | 7/2000 |
| RU | 2516998 | C2 | 10/2013 |
| WO | 2009078577 | A1 | 6/2009 |

* cited by examiner

SHELL-AND-TUBE HEAT EXCHANGER

CROSS REFERENCE TO RELATED APPLICATIONS

This application is a national phase nonprovisional patent application of PCT/KR2018/011154 filed on Sep. 20, 2018, which claims the benefit of Korean Patent Application No. 10-2017-0127204, filed in the Korean Intellectual Property Office on Sep. 29, 2017, the entire contents of which are incorporated herein by reference.

TECHNICAL FIELD

The present disclosure relates to a shell-and-tube type heat exchanger.

BACKGROUND ART

A shell-and-tube type heat exchanger is used as a type of heat exchanger. The shell-and-tube type heat exchanger extends along one direction in a form such as a tube and is formed such that heat exchange between heating water and high-temperature gas is performed inside. When the gas heated by a heat source and the heating water flow on opposite sides of a boundary through which heat exchange is possible, the heating water is heated by receiving heat from the gas. In terms of thermal efficiency, it is preferable to design the heat exchanger such that when the heating water passes through the heat exchanger, the heating water performs heat exchange for a long period of time while slowly flowing through the heat exchanger. However, it is not preferable that a flow stagnation area where the heating water stagnates without flowing be generated.

Technical Problem

The present disclosure has been made to solve the above-mentioned problems. An aspect of the present disclosure provides a shell-and-tube type heat exchanger for reducing a flow stagnation area.

Technical Solution

According to an aspect of the present disclosure, a shell-and-tube type heat exchanger includes an outer container in a cylindrical shape, in which openings are formed at opposite ends of the outer container, an empty space connected with the openings at the opposite ends is provided in the outer container, an inlet through which heating water is introduced into the empty space is provided at one end side of the outer container, and an outlet through which the heating water is discharged from the empty space is provided at an opposite end side of the outer container, a lower tube plate that covers the opening at the one end side of the outer container, an upper tube plate in a cylindrical shape that covers the opening at the opposite end side of the outer container and provides an interior space in which a heat source that heats the heating water is located, a plurality of flues that guide combustion gas generated by the heat source from the upper tube plate to the outside of the lower tube plate, and a main diaphragm in a circular plate shape that is disposed between the lower tube plate and the upper tube plate across a reference direction that is a direction toward the opposite end side from the one end side of the outer container, in which a plurality of through-holes through which the flues pass are formed in the main diaphragm. At least some of the through-holes are wide through-holes, each of which is a single hole through which two or more flues among the flues pass together.

Advantageous Effects

Accordingly, the flow stagnation area of the shell-and-tube type heat exchanger may be reduced, which results in high heat-transfer efficiency.

Heating water may be induced to flow around the flues when passing through the main diaphragm, which results in efficient heat exchange between the heating water and the flues.

MODE FOR INVENTION

Figure 1:
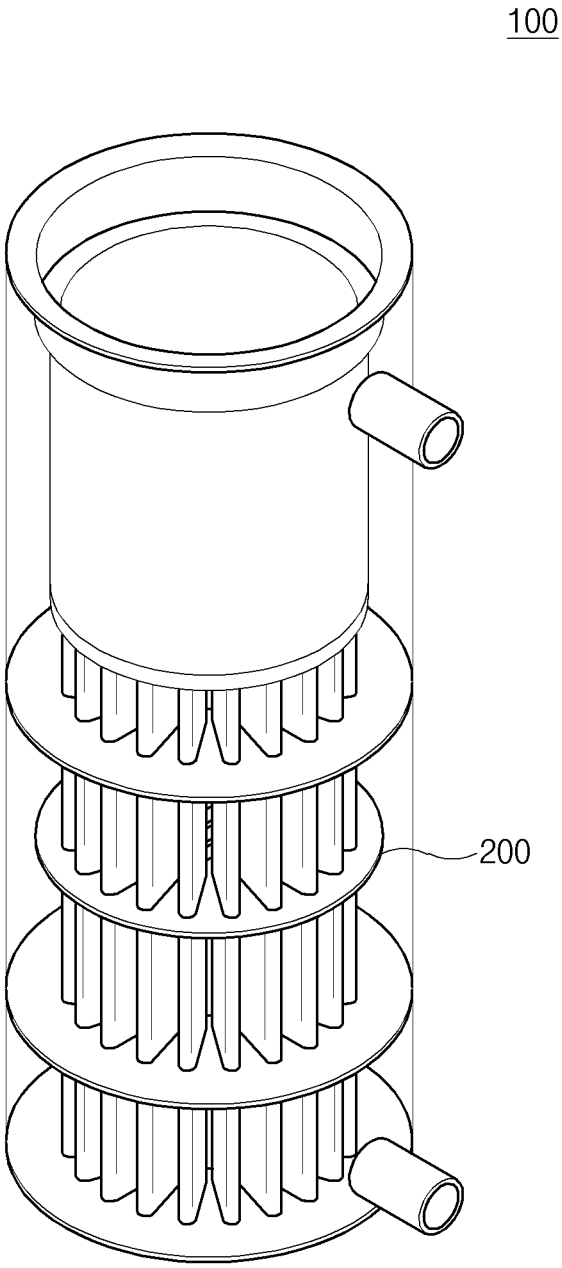
FIG. 1 is an exemplary perspective view of a shell-and-tube type heat exchanger.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the components. When a component is described as "connected", "coupled", or "linked" to another component, this may mean the components are not only directly "connected", "coupled", or "linked" but also are indirectly "connected", "coupled", or "linked" via a third component.

FIG. 1 is an exemplary perspective view of a shell-and-tube type heat exchanger.

A method of making a flow path of heating water long to the maximum by disposing a diaphragm 200 in a limited space, as illustrated in FIG. 1, to allow the heating water to perform heat exchange for a long period of time while slowly passing through the inside of the shell-and-tube type heat exchanger 100 has been designed. The shell-and-tube type heat exchanger 100 extends in one direction, and the diaphragm 200 formed in a direction not parallel to the one direction is disposed in the shell-and-tube type heat exchanger 100. The flow path of the heating water is extended in such a manner that the diaphragm 200 stops the heating water from moving in the one direction within the shell-and-tube type heat exchanger 100 and allows the heating water to detour and reach the final destination.

Figure 2:
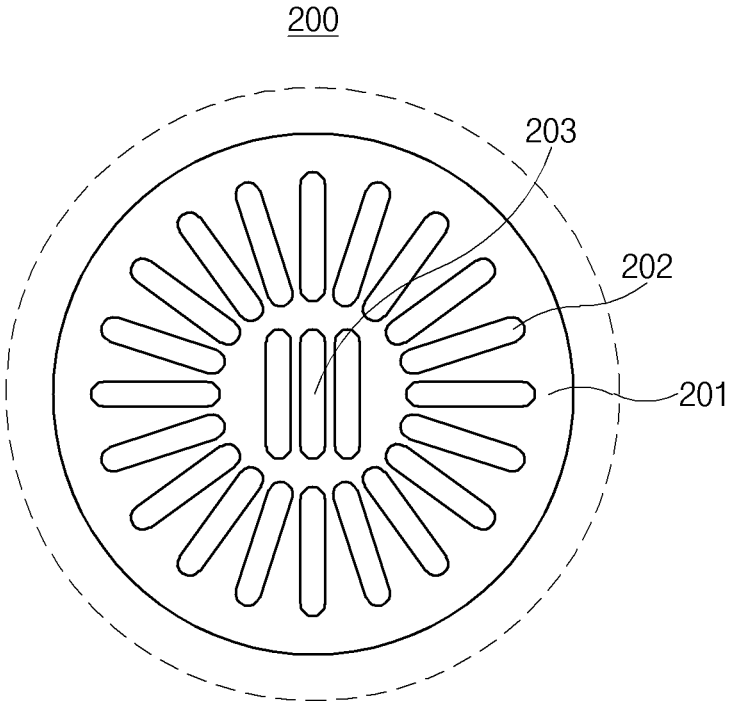
FIG. 2 is a plan view of a diaphragm used in the shell-and-tube type heat exchanger of FIG. 1.

FIG. 2 is a plan view of the diaphragm used in the shell-and-tube type heat exchanger of FIG. 1. Referring to FIG. 2, the diaphragm 200 used to form a flow path in an interior space of the shell-and-tube type heat exchanger 100 and how through-holes 202 and central through-holes 203 are formed in the diaphragm can be identified. The central through-holes 203 are formed in the center of a plate 201 of the diaphragm 200, and the through-holes 202 are formed to surround the central through-holes 203. Furthermore, the diameter of the plate 201 is formed to be smaller than the diameter of an inner circumferential surface of the shell-and-tube type heat exchanger 100.

The heating water passes the diaphragm 200 through the clearance formed between the plate 201 and the inner circumferential surface of the shell-and-tube type heat exchanger 100.

The shell-and-tube type heat exchanger 100 of FIG. 1 may further include a diaphragm having an opening in a different shape, and a flow path along which the heating water alternately moves in radially inward and outward directions is formed depending on the arrangement of the diaphragms.

Figure 3:
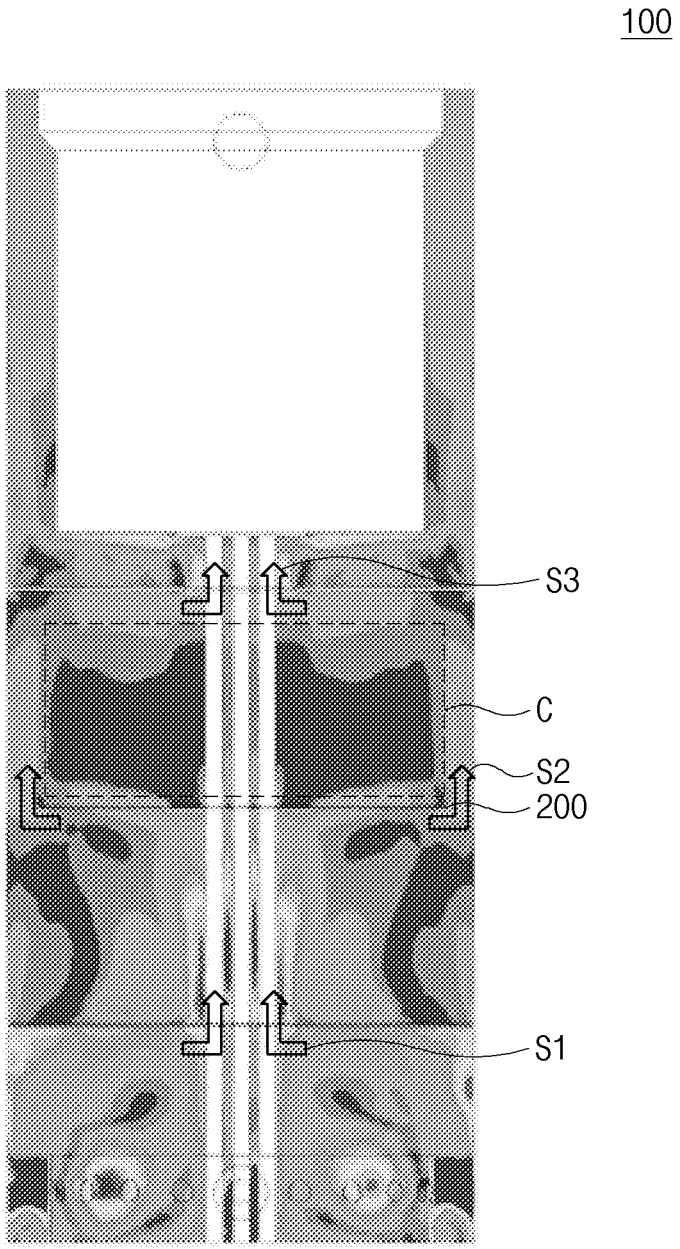
FIG. 3 is a view illustrating a flow situation of heating water in the shell-and-tube type heat exchanger of FIG. 1.

FIG. 3 is a view illustrating a flow situation of heating water in the shell-and-tube type heat exchanger of FIG. 1. In the drawing, brightness is differently displayed depending on the flow speed of the heating water in a corresponding area. The higher the brightness of an area, the lower the flow speed of the heating water in the corresponding area.

However, referring to FIG. 3, it can be seen that in the shell-and-tube type heat exchanger 100, a flow stagnation area C where the heating water stagnates without flowing is generated above the diaphragm 200. As described above, it is preferable that the heating water perform heat exchange for a long period of time while slowly flowing through the inside of the shell-and-tube type heat exchanger 100. However, when the heating water stagnates as illustrated in FIG. 3 without flowing, the following low-temperature heating water fails to appropriately receive heat exchange. Furthermore, the heating water already heated fails to be delivered to a user, which results in deterioration in the efficiency of the shell-and-tube type heat exchanger 100. To remove the flow stagnation area C, a shell-and-tube type heat exchanger 1 according to an embodiment of the present disclosure is presented as described below.

First Embodiment

Figure 4:
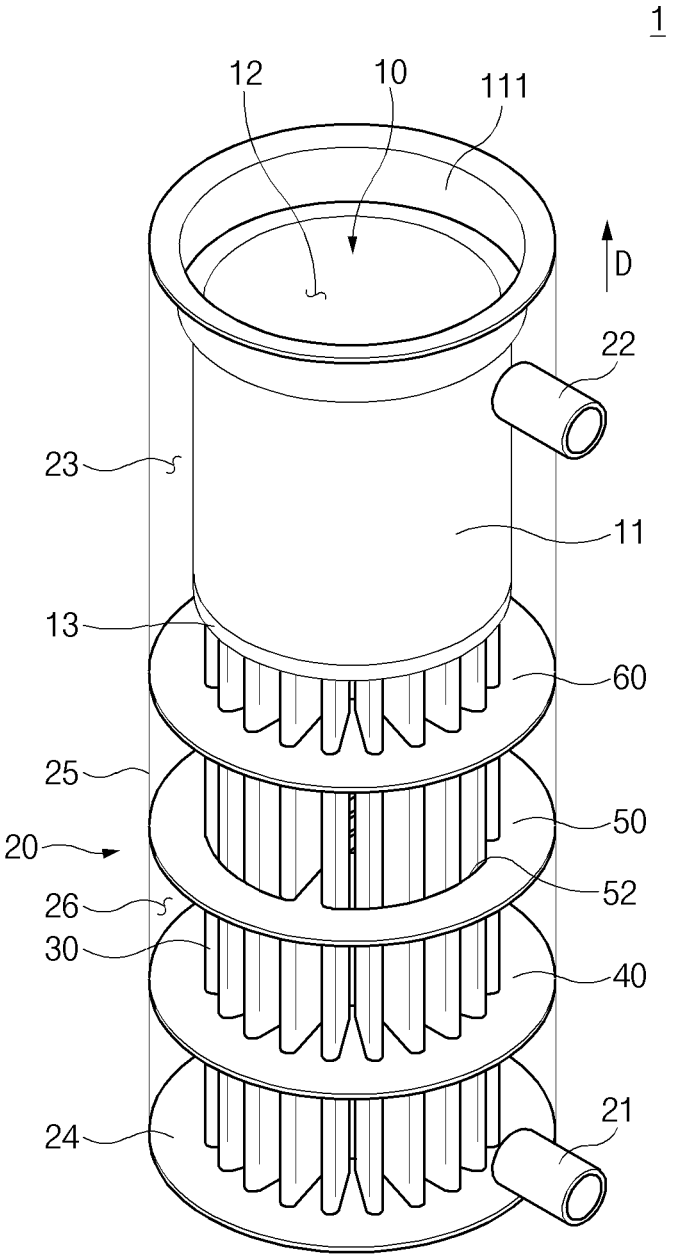
FIG. 4 is a perspective view of a shell-and-tube type heat exchanger according to a first embodiment of the present disclosure.
Figure 5:
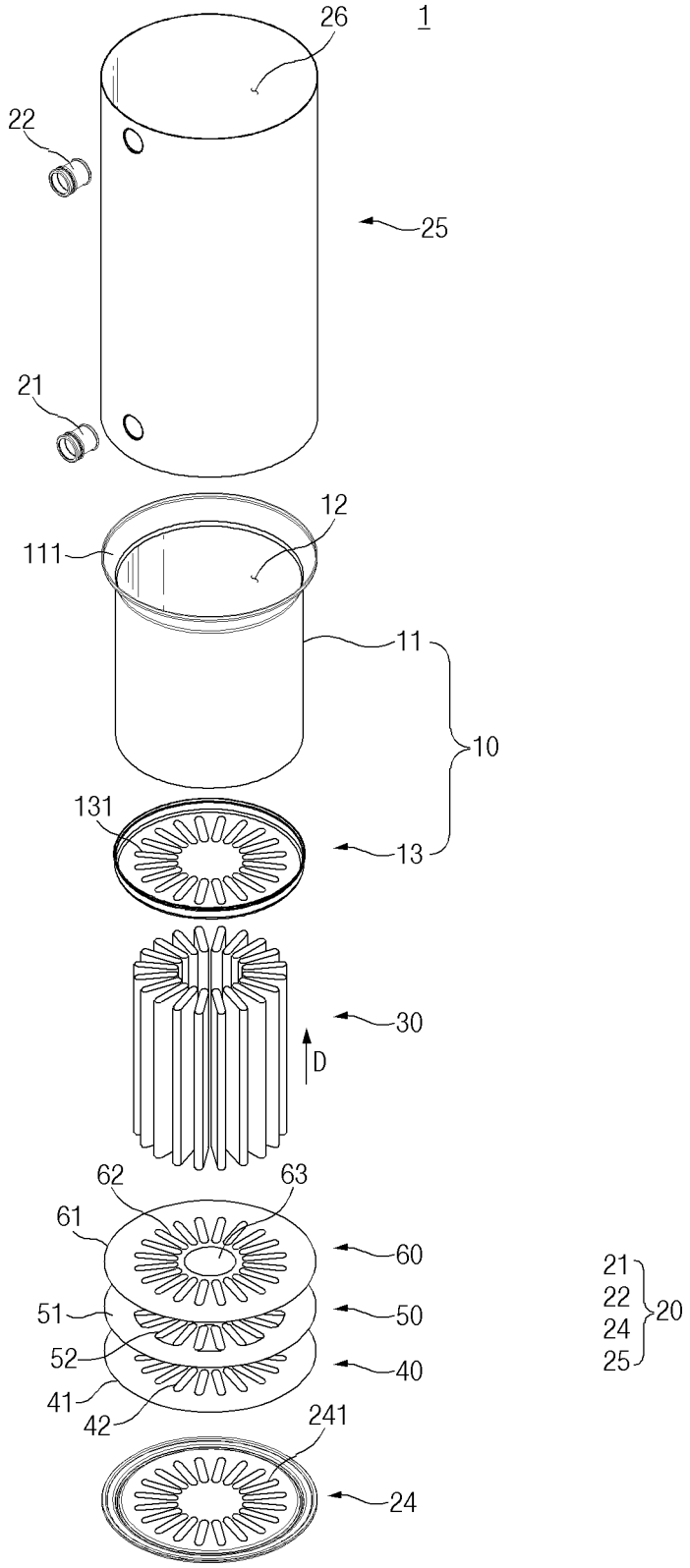
FIG. 5 is an exploded perspective view of the shell-and-tube type heat exchanger of FIG. 4.

FIG. 4 is a perspective view of a shell-and-tube type heat exchanger according to a first embodiment of the present disclosure. FIG. 5 is an exploded perspective view of the shell-and-tube type heat exchanger of FIG. 4.

Referring to FIGS. 4 and 5, the shell-and-tube type heat exchanger 1 according to the first embodiment of the present disclosure includes an outer container 20, a lower tube plate 24, an upper tube plate 10, a plurality of flues 30, and a main diaphragm 50.

Outer Container 20

The outer container 20 is a main body of the shell-and-tube type heat exchanger 1 that is formed in a cylindrical shape, and receives, in a cylindrical interior space thereof, components constituting the shell-and-tube type heat exchanger 1.

Openings are formed at opposite ends of the outer container 20, an empty space 26 connected with the openings at the opposite ends is provided inside, an inlet 21 through which heating water is introduced into the empty space 26 is provided at one end side, and an outlet 22 through which the heating water is discharged from the empty space 26 is provided at an opposite end side.

The outer container 20 has the openings at the opposite ends, and the openings at opposite ends are connected by the empty space 26 that forms the interior space.

The direction toward the opposite end side from the one end side of the outer container 20 is referred to as the reference direction D in this specification. Accordingly, when described using the reference direction D, the outer container 20 includes an outer container extension 25 extending along the reference direction D, and distal ends of the outer container extension 25 in the reference direction D and the opposite direction are formed in an open cylindrical shape.

The opening at the one end side of the outer container 20 is covered by the lower tube plate 24. Here, the expression "the lower tube plate 24 covers the opening" means that, as illustrated in the drawings, the periphery of the opening located at the one end of the outer container 20 is completely covered from the outside. However, even though the lower tube plate 24 is coupled in such a manner that the lower tube plate 24 is inserted into the opening of the outer container 20 and coupled to an inner circumferential surface of the empty space 26 of the outer container 20 to isolate the empty space 26 from the outside, with the periphery of the opening protruding toward the outside, the lower tube plate 24 may be expressed as covering the opening.

Accordingly, the lower tube plate 24 may isolate the empty space 26 disposed inside the outer container 20 from the outside. Lower tube plate through-holes 241 through which the plurality of flues 30, which will be described below, pass may be formed in the lower tube plate 24.

Although the lower tube plate 24 is illustrated as being formed independently of the outer container 20 in the first embodiment of the present disclosure, the lower tube plate 24 disposed at the one end of the outer container 20 may be integrally formed with the outer container 20. Furthermore, the lower tube plate 24 may be located at the one end of the outer container 20 without covering the entire opening at the one end of the outer container 20.

The opening at the opposite end side of the outer container 20 is covered by the upper tube plate 10. As the openings formed at the opposite ends of the outer container 20 are covered by the lower tube plate 24 and the upper tube plate 10, the empty space 26 is formed in the interior space of the outer container 20. The heating water may be introduced and received in the empty space 26 by the inlet 21 provided at the one end side of the outer container 20. The heating water introduced into the empty space 26 through the inlet 21 may be discharged through the outlet 22 provided at the opposite end side of the outer container 20.

Upper Tube Plate 10

The upper tube plate 10 is another component in a cylindrical shape that covers the opening at the opposite end side of the outer container 20, and is a component in which a heat source for heating the heating water is disposed in an interior space 12 of the upper tube plate. The upper tube plate 10 provides the interior space 12 extending toward the one end side from the opposite end side of the outer container 20, as an interior space for locating, in the empty space 26 of the outer container 20, the heat source for heating the heating water. The upper tube plate 10 formed in a cylindrical shape extends toward the one end side of the outer container 20 from the opposite end side of the outer container 20, but does not reach the one end side of the outer container 20. The heat source may be disposed in the interior space 12 of the upper tube plate and may heat the upper tube plate 10 to transfer heat to the heating water. Furthermore, the heat source may generate combustion gas by heating gas received in the upper tube plate 10. The combustion gas generated by heating of the heat source may be discharged from the upper tube plate 10 to the outside through the flues 30 and the empty space 26 of the outer container 20. In this process, the combustion gas passing through the flues 30 may heat the heating water passing through the empty space 26.

One end of the upper tube plate 10 is covered by an upper tube plate cover 13. Upper tube plate through-holes 131 through which the flues 30, which will be described below, pass may be formed in the upper tube plate cover 13. Although the upper tube plate cover 13 is illustrated as being removable in the first embodiment of the present disclosure, the upper tube plate 10 may be integrally formed with the upper tube plate cover 13.

An opposite end 111 of the upper tube plate may be formed to have a diameter corresponding to the opposite end of the outer container 20 and may be coupled with the opposite end of the outer container 20 to close the opposite end of the outer container 20 to form the empty space 26 of the closed outer container 20. However, the diameter of an upper tube plate extension 11 extending from the opposite end side of the outer container 20 to the one end side of the outer container 20 may be formed to be smaller than the diameter of the outer container 20. Accordingly, the upper tube plate 10 may have a tapered shape extending from the upper tube plate extension 11 to the opposite end 111 of the upper tube plate.

As the diameter of the upper tube plate extension 11 is formed to be smaller than the diameter of the outer container 20, a flow space 23 may be formed between an inner circumferential surface of the outer container 20 and an outer circumferential surface of the upper tube plate 10. The heating water may flow from the empty space 26 through the flow space 23. The outlet 22 of the outer container 20 that is formed at the opposite end of the outer container 20 may be connected to the flow space 23. Accordingly, the heating water flowing in the flow space 23 may be discharged through the outlet 22 of the outer container 20. The heating water flowing in the flow space 23 finally receives heat from the upper tube plate 10 heated by the heat source and is discharged through the outlet 22 formed in the outer container 20.

Flues 30

The plurality of flues 30 are tubular components disposed between the lower tube plate 24 and the upper tube plate 10 and connected with the interior space 12 of the upper tube plate and the outside of the lower tube plate 24. Accordingly, the plurality of flues 30 guide the combustion gas generated by the heat source from the interior space 12 of the upper tube plate to the outside of the lower tube plate 24 through the empty space 26 of the outer container 20. According to the first embodiment of the present disclosure, the flues 30 extend along the reference direction D. Accordingly, the heated combustion gas moves in the opposite direction to the reference direction D through the flues 30. In the process in which the combustion gas moves, heat exchange between the heating water moving in the reference direction D through the empty space 26 of the outer container 20 and the combustion gas is performed through the flues 30.

The plurality of flues 30 may be radially disposed from the center of the circular cross-section of the outer container 20 and the upper tube plate 10. The center of the circular cross-section may be the same as the center of the main diaphragm 50 in a circular plate shape that will be described below. Accordingly, as in the first embodiment of the present disclosure, the flues 30 may be disposed along one circumference at predetermined intervals. However, the flues 30 may be disposed at predetermined intervals along two circumferences having different diameters and may be disposed in two stages, and the arrangement is not limited thereto.

Main Diaphragm 50

The main diaphragm 50 is disposed in the empty space 26 of the outer container 20 that is formed in the outer container 20. The main diaphragm 50 is a component formed in a circular plate shape and is disposed between the lower tube plate 24 and the upper tube plate 10 of the outer container 20 across the reference direction D. Although the main diaphragm 50 is disposed perpendicular to the reference direction D in the first embodiment of the present disclosure, the direction in which the main diaphragm 50 is disposed is not limited thereto.

Figure 6:
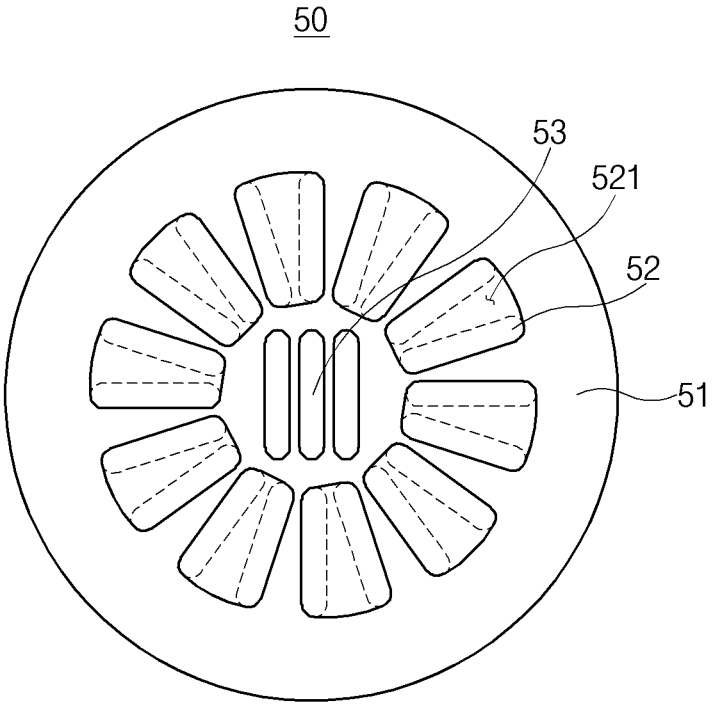
FIG. 6 is a plan view of a main diaphragm used in the shell-and-tube type heat exchanger of FIG. 4.

FIG. 6 is a plan view of the main diaphragm used in the shell-and-tube type heat exchanger of FIG. 4.

A plurality of through-holes 52 are formed in a plate 51 of the main diaphragm. At points where the main diaphragm 50 and the flues 30 meet, the through-holes 52 of the main diaphragm 50 are formed to be open in a shape through which the flues 30 are capable of passing. Accordingly, the plurality of flues 30 may pass through the through-holes 52 and may extend along the reference direction D to connect the upper tube plate cover 13 and the lower tube plate 24.

At least some of the through-holes 52 of the main diaphragm 50 are wide through-holes. Each of the wide through-holes refers to a single hole through which two or more flues 30 pass together, among the through-holes 52. An empty space 521 between two adjacent flues 30, among the flues 30 passing through the wide through-hole, is also formed in an open form. Accordingly, the heating water in the empty space 26 may enter or leave along the reference direction D through the empty space 521. The heating water passes through the main diaphragm 50 along the reference direction D through the empty space 521. In an exemplary embodiment, the wide through-hole has an opened part which is an empty space between two adjacent flues passing through the wide through-hole. A width of the opened part, starting from a certain point which is offset from the radially inward end, increases as going radially outward direction. A width of a radially outward end of the opened part is bigger than that of the radially inward end of the opened part.

The wide through-hole of the main diaphragm 50 may be a single hole that surrounds two flues 30 located at the outermost position with respect to a circumferential direction, among the flues 30 passing through the wide through-hole, and a space defined between the two flues 30. Two or more flues 30 rather than only two flues 30 may pass through the wide through-hole. Accordingly, the wide through-hole may be formed such that the two flues 30 located at the outermost position along the circumferential direction serve as a circumferential boundary of the wide through-hole and a single hole surrounds the entirety of the space therebetween.

To determine a radial boundary of the space defined by the two flues 30 located at the outermost position with respect to the circumferential direction, a line circumferentially connecting radially inward distal ends of the flues 30 passing through the wide through-hole and a line circumferentially connecting radially outward distal ends of the flues 30 may be additionally considered. Accordingly, a single wide through-hole may be formed to surround the two lines and the space defined by the two flues 30 located at the outermost position with respect to the circumferential direction.

The wide through-holes may all be formed such that the same number of adjacent flues 30 pass together, or the wide through-holes may be formed in a plurality of types such that a different number of adjacent flues 30 pass together.

The through-holes 52 of the main diaphragm 50 according to the first embodiment illustrated in FIG. 6 are wide through-holes through which two adjacent flues 30 pass together. To this end, the flues 30 according to the first embodiment may be radially disposed with respect to the center of the main diaphragm 50 and may be provided in a multiple of 2.

Referring again to FIGS. 4 and 5, the diameter of the main diaphragm 50 may be formed to be equal to the diameter of the inner circumferential surface of the outer container 20. Accordingly, an outer circumferential surface of the main diaphragm 50 may be tightly coupled with the inner circumferential surface of the outer container 20. Unlike the structure in which the outer circumferential surface of the main diaphragm is disposed to be spaced apart from the inner circumferential surface of the outer container 20 so that the heating water can move in the reference direction D along the spacing space, the heating water cannot move through the space between the inner circumferential surface of the outer container 20 and the outer circumferential surface of the main diaphragm 50 in the present disclosure. Accordingly, the heating water may pass through the main diaphragm 50 along the reference direction D only through central through-holes 53 or the spaces between the flues 30 and the through-holes 52 surrounding the flues 30.

Modified Examples of Main Diaphragm

Figure 7:
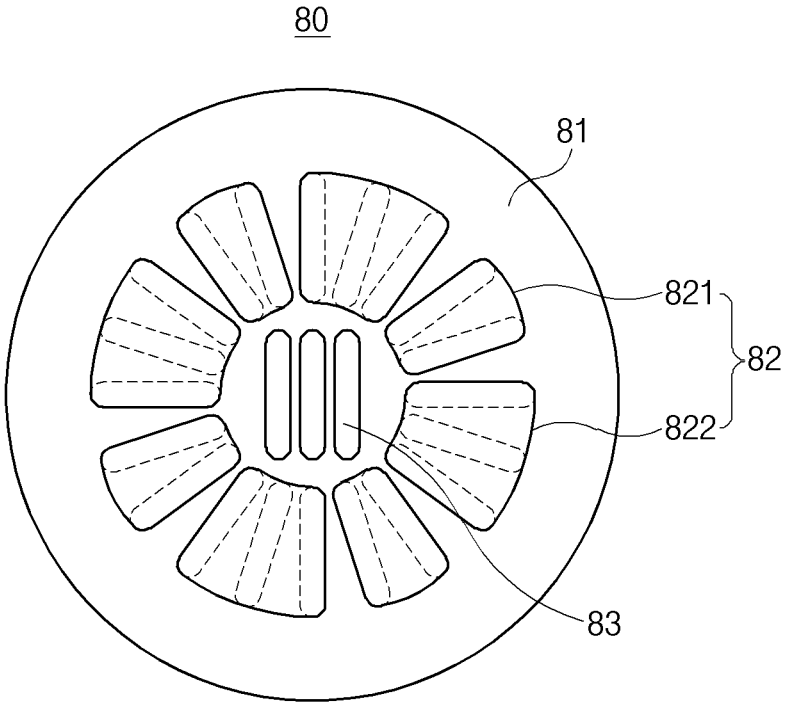
FIG. 7 is a plan view illustrating a first modified example of the main diaphragm of FIG. 6.

FIG. 7 is a plan view illustrating a first modified example of the main diaphragm of FIG. 6.

Each of through-holes 82 formed in a plate 81 of a main diaphragm 80 illustrated in FIG. 7 is one of a first wide through-hole 821 and a second wide through-hole 822. The first wide through-hole 821 is a wide through-hole through which two adjacent flues 30 pass together, and the second wide through-hole 822 is a wide through-hole through which three adjacent flues 30 pass together. Accordingly, the plurality of flues 30 according to this modified example may be provided in a multiple of 5.

The first wide through-hole 821 and the second wide through-hole 822 may be alternately disposed along a circumferential direction of the main diaphragm 80. The aim is to prevent a non-uniform flow of heating water (that is like to occur) due to an arrangement of wide through-holes of a single type in one area.

Figure 8:
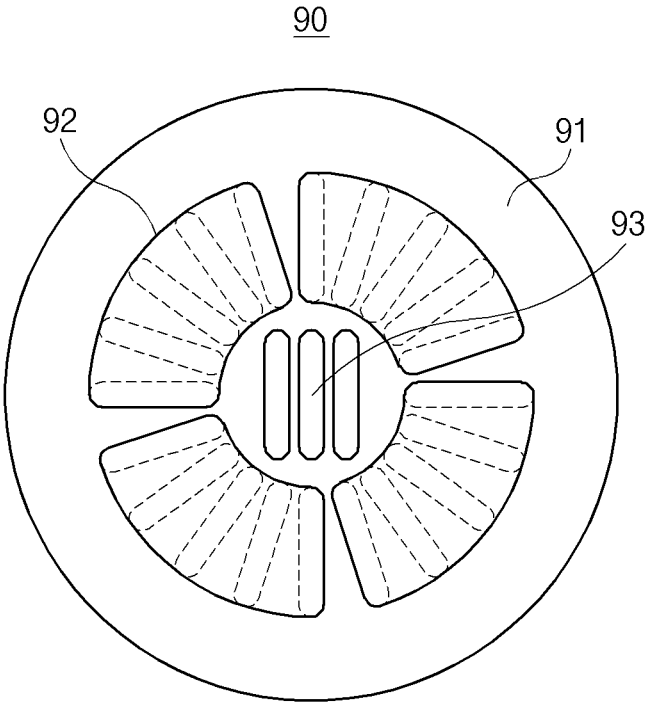
FIG. 8 is a plan view illustrating a second modified example of the main diaphragm of FIG. 6.

FIG. 8 is a plan view illustrating a second modified example of the main diaphragm of FIG. 6.

Each of through-holes 92 formed in a plate 91 of a main diaphragm 90 illustrated in FIG. 8 is a wide through-hole through which four adjacent flues 30 pass together. To this end, the flues 30 according to a third embodiment may be radially disposed with respect to the center of the main diaphragm 90 and may be provided in a multiple of 4.

A central through-hole 53, 73, 83, or 93 may be formed in the center of the main diaphragm 50, 70, 80, or 90 to pass through the main diaphragm 50, 70, 80, or 90 and extend in any radial direction of the main diaphragm 50, 70, 80, or 90. At least some flues 30 among the plurality of flues 30 pass through the central through-hole 53, 73, 83, or 93. A plurality of central through-holes 53, 73, 83, or 93 may be formed and may be disposed to be spaced apart from each other in a direction perpendicular to one radial direction that is an extension direction of the through-holes 53, 73, 83, or 93. In the embodiment of the present disclosure, it is exemplified that a total of three central through-holes 53, 73, 83, or 93 are formed. However, the number and arrangement direction of central through-holes are not limited thereto. Furthermore, likewise to the through-holes 52, 72, 82, or 92, some of the central through-holes 53, 73, 83, or 93 may also form wide through-holes.

First Diaphragm 40 and Second Diaphragm 60

Figure 9:
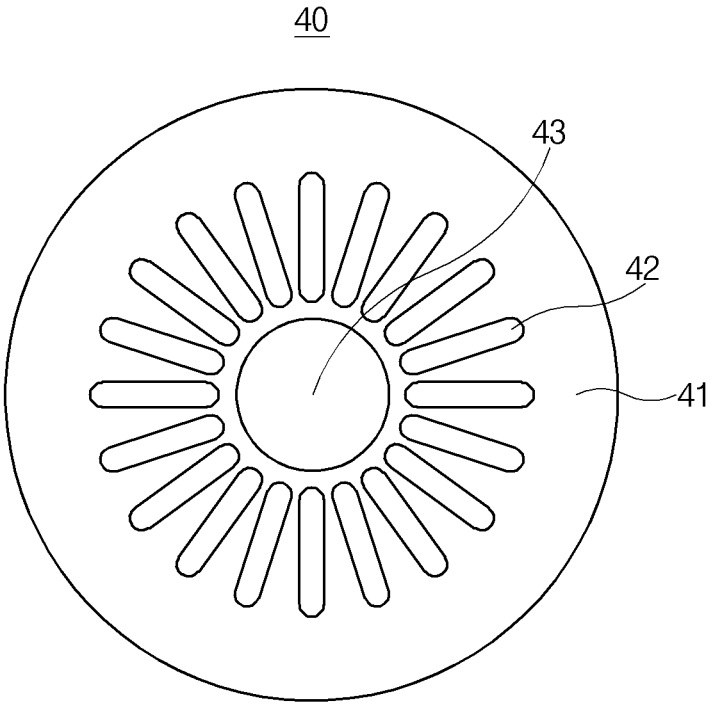
FIG. 9 is a plan view of a first diaphragm used in the shell-and-tube type heat exchanger of FIG. 4.

The shell-and-tube type heat exchanger 1 according to the first embodiment of the present disclosure may further include the first diaphragm 40 or the second diaphragm 60. The first diaphragm 40 and the second diaphragm 60 will be described below with reference to FIGS. 4, 5, and 9. FIG. 9 is a plan view of the first diaphragm used in the shell-and-tube type heat exchanger of FIG. 4.

The diaphragm illustrated in FIG. 9 is the first diaphragm 40. The first diaphragm 40 is disposed between the main diaphragm 50 and the lower tube plate 24 across the reference direction D, and the second diaphragm 60 is disposed between the main diaphragm 50 and the upper tube plate 10 across the reference direction D. The first diaphragm 40 and the second diaphragm 60 may be formed in the same form as in the first embodiment of the present disclosure, but may be formed in different forms. The first diaphragm 40 and the second diaphragm 60 have the same form in the embodiment of the present disclosure. Therefore, description of the first diaphragm 40 may be applied to the second diaphragm 60.

The first diaphragm 40 is formed in a circular plate shape, like the main diaphragm 50. Furthermore, a plurality of through-holes 42 through which the flues 30 pass are formed in a plate 41 of the first diaphragm. However, the through-holes 42 formed in the first diaphragm 40 are not formed in a form in which a predetermined area is open such that the plurality of flues 30 pass together, and the same number of through-holes 42 as the flues 30 are formed in the positions through which the flues 30 pass, such that the flues 30 individually pass.

A central hole 43 is formed in the center of the first diaphragm 40. The central hole 43 may be an opening formed to provide a flow passage through which the heating water passes, and the heating water may pass through the first diaphragm 40 via the central hole 43 along the reference direction D. The central hole 43 may be formed in a circular shape as illustrated, but the shape is not limited thereto.

Operation of Wide Through-Holes of Main Diaphragm 50

Hereinafter, a case where the main diaphragm 50 according to the embodiment of the present disclosure is introduced into the shell-and-tube type heat exchanger 1 will be described with reference to FIG. 10.

Figure 10:
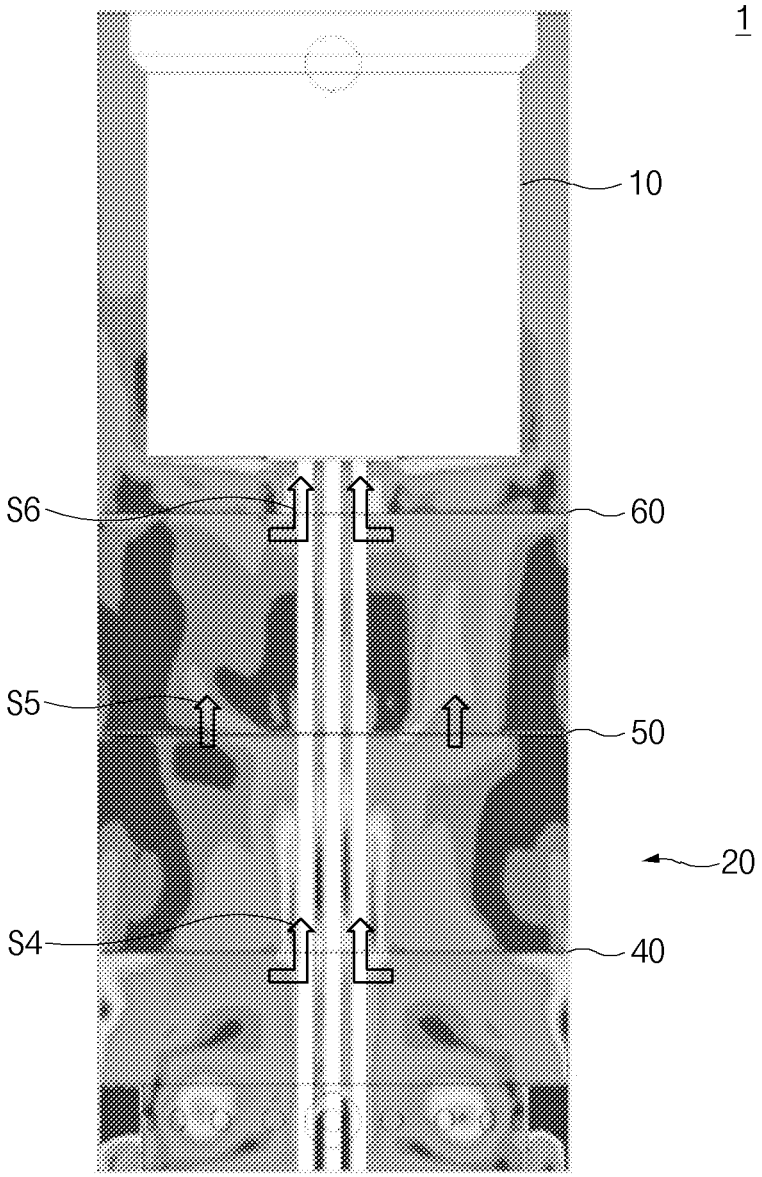
FIG. 10 is a view illustrating a flow situation of heating water in the shell-and-tube type heat exchanger of FIG. 4.

FIG. 10 is a view illustrating a flow situation of heating water in the shell-and-tube type heat exchanger of FIG. 4. In addition to the main diaphragm 50, the shell-and-tube type heat exchanger 1 illustrated in FIG. 10 further includes the first diaphragm 40 disposed between the main diaphragm 50 and the lower tube plate 24 and the second diaphragm 60 disposed between the main diaphragm 50 and the upper tube plate 10.

In the case of the structure of FIGS. 1 and 2, referring to FIG. 3, due to the shape of the through-holes 202 of the diaphragm 200, heating water moves along a winding path while moving in the reference direction in the shell-and-tube type heat exchanger 100. To pass through another diaphragm formed below the diaphragm, the heating water moves in the reference direction from the radially inward portion of the diaphragm. The heating water 51 passing through an opening formed in the center of the other diaphragm moves to the radially outward portion of the diaphragm and passes through the space between the diaphragm 200 and the inner circumferential surface of the shell-and-tube type heat exchanger 100 along the reference direction. The heating water S2 passing through the diaphragm 200 moves to the radially inward portion of the diaphragm 200 again and, along the reference direction, passes through an opening formed in the center of another diaphragm disposed above the diaphragm 200. The heating water S3 passing through the last diaphragm is discharged after exchanging heat with the upper tube plate. Referring to FIG. 3, due to this, the flow stagnation area C is formed on the side surface of the diaphragm 200 that faces the reference direction.

However, referring to FIG. 10, the heating water moves in the reference direction D in the empty space 26 along the path different from that in FIG. 2. As in FIG. 3, in FIG. 10, the higher the brightness of an area, the lower the flow speed of the heating water in the corresponding area. The heating water flows into the empty space 26 through the inlet 21 and meets the first diaphragm 40. To pass through the first diaphragm 40, the heating water moves to the radially inward portion of the first diaphragm 40. The heating water S4 passing through the central hole 43 of the first diaphragm passes through the main diaphragm 50 along the reference direction D via the wide through-holes of the main diaphragm 50. At this time, because the plurality of adjacent flues 30 pass through the wide through-holes, the spaces by which the heating water passes through the first diaphragm 40 via the wide through-holes are the empty spaces 521 between the outer circumferential surfaces of the flues 30 and the inner circumferential surfaces of the wide through-holes. The wide through-holes are disposed at predetermined intervals along the circumferential direction, but are not located at the outermost position in the radial direction of the main diaphragm 50. Furthermore, the outside surface of the main diaphragm 50 is tightly coupled to the inner circumferential surface of the outer container 20. Accordingly, to pass through the main diaphragm 50, the heating water moves only to the areas where the wide through-holes are located, without moving to the outermost position in the radial direction of the main diaphragm 50.

Thereafter, the heating water S5 passing through the main diaphragm 50 passes through the second diaphragm 60 via the central hole 63 of the second diaphragm and enters the flow space 23 to exchange heat with the upper tube plate 10. The heating water S6 passing through the central hole 63 of the second diaphragm passes through the flow space 23 and is discharged through the outlet 22 located on the opposite side of the outer container 20.

The shape and arrangement of the through-holes 52 of the main diaphragm 50 are uniform over the entire main diaphragm 50 as described above. Therefore, as can be seen in FIG. 10, the flow stagnation area C of FIG. 3 disappears, and an entirely smooth flow is made. As in FIG. 3, in FIG. 10, the higher the brightness of an area, the lower the flow speed. However, because the through-holes 52 of the main diaphragm 50 are not open without any limitation over a very wide area, a situation in which the heating water very rapidly passes through the empty space 26 so that thermal efficiency is lowered does not occur.

Furthermore, the wide through-holes of the main diaphragm 50 are formed to surround the flues 30, and the empty space 521 between the flues 30 allows the heating water to flow. Therefore, the heating water flows around the flues 30 when passing through the main diaphragm 50. Accordingly, heat exchange between the heating water and the flues 30 is more efficiently performed, and thus the heat transfer areas of the flues 30 may all be used without occurrence of a high pressure drop.

The flow passage in the case where the outer circumferential surface of the main diaphragm 50 is tightly coupled to the inner circumferential surface of the outer container 20 has been illustrated and described in the first embodiment of the present disclosure. However, in another modified example, the outer circumferential surface of the main diaphragm 50 may not be coupled to the inner circumferential surface of the outer container 20. Even in the modified example, by the formation of the flow passage through the wide through-holes, the heat transfer areas of the flues 30 may be wholly used to raise the thermal efficiency of the shell-and-tube type heat exchanger.

Figure 11:
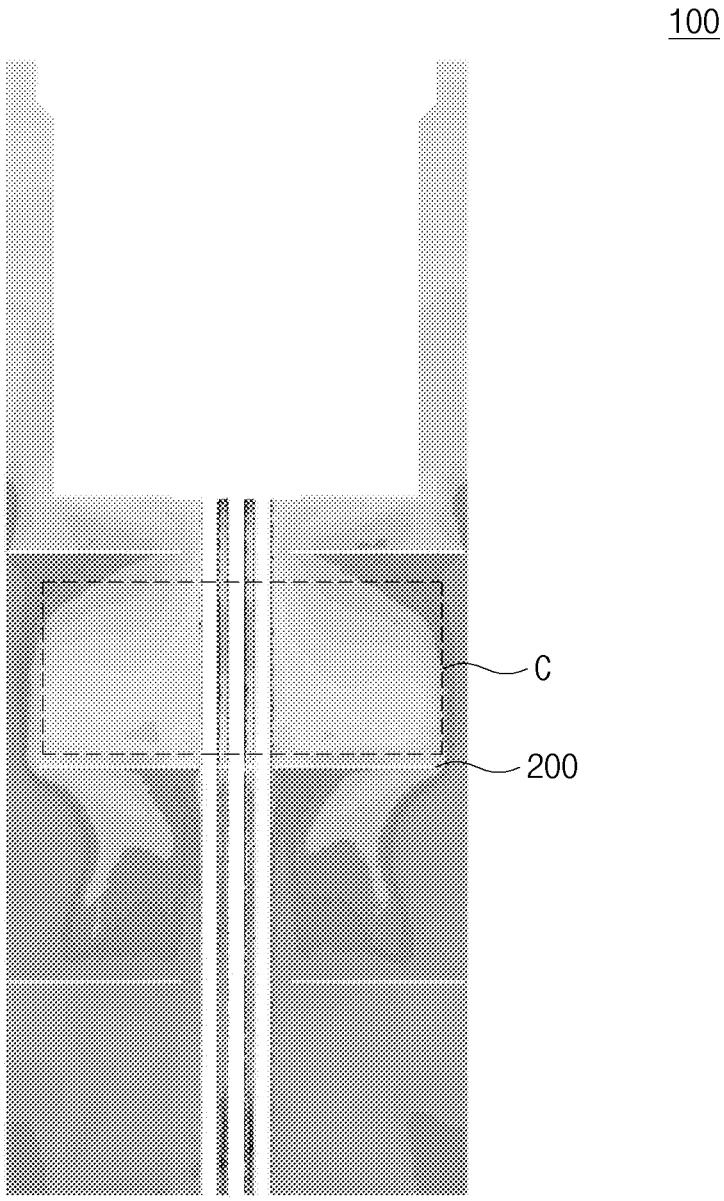
FIG. 11 is a view illustrating temperature distribution of heating water in the shell-and-tube type heat exchanger of FIG. 1.

FIG. 11 is a view illustrating temperature distribution of heating water in the shell-and-tube type heat exchanger 100 of FIG. 1.

In FIG. 11, the higher the brightness of an area, the lower the temperature of the heating water in the corresponding area. The flow of the heating water in FIG. 11 is the same as that illustrated in FIG. 3. Referring to FIG. 11, it can be seen that the flow stagnation area C is generated in the shell-and-tube type heat exchanger 100 of FIG. 1. It can be seen that as the flow stagnates above the diaphragm 200, the heating water is excessively heated to represent high temperature around the flues 30 located above the diaphragm 200.

Figure 12:
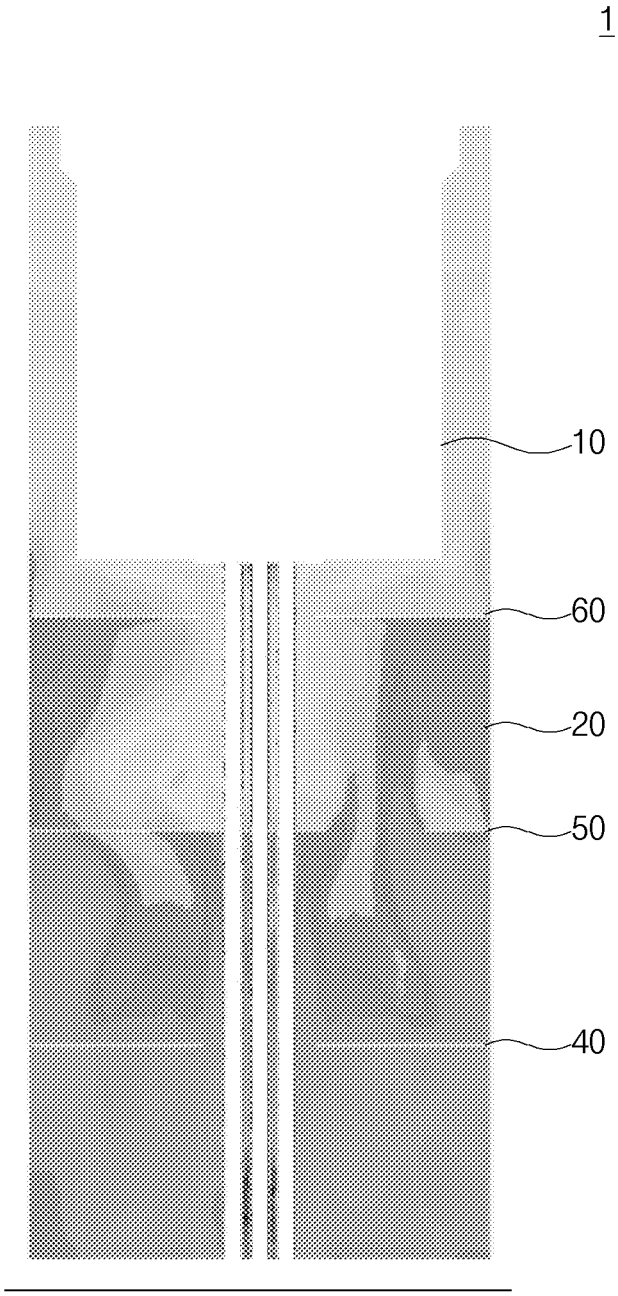
FIG. 12 is a view illustrating temperature distribution of heating water in the shell-and-tube type heat exchanger of FIG. 4.

In contrast, referring to FIG. 12, which is a view illustrating temperature distribution of heating water in the shell-and-tube type heat exchanger 1 of FIG. 4, it can be seen that the flow stagnation area C illustrated in FIG. 11 is not generated in the shell-and-tube type heat exchanger 1 according to the first embodiment of the present disclosure. As in FIG. 11, in FIG. 12, the higher the brightness of an area, the lower the temperature of the heating water in the corresponding area. The flow of the heating water in FIG. 12 is the same as that illustrated in FIG. 10. In the drawing, it can be seen that a flow is generated through the main diaphragm 50 in an area adjacent to the flues 30 and the heating water flows without being excessively heated while staying.

Furthermore, according to an experimental example, the heating water of FIG. 11 has a temperature of 79.4° C. when finally discharged, and the heating water of FIG. 12 has a temperature of 80.3° C. when finally discharged. Accordingly, by using the shell-and-tube type heat exchanger 1 according to the first embodiment of the present disclosure, the flow stagnation area C is reduced, and the heating water smoothly flows in the shell-and-tube type heat exchanger 1. The shell-and-tube type heat exchanger 1 according to the first embodiment of the present disclosure obtains an effect of increasing the temperature of the finally discharged heating water due to a smooth flow of the heating water that is caused by the modified form of the main diaphragm 50.

Second Embodiment

Figure 13:
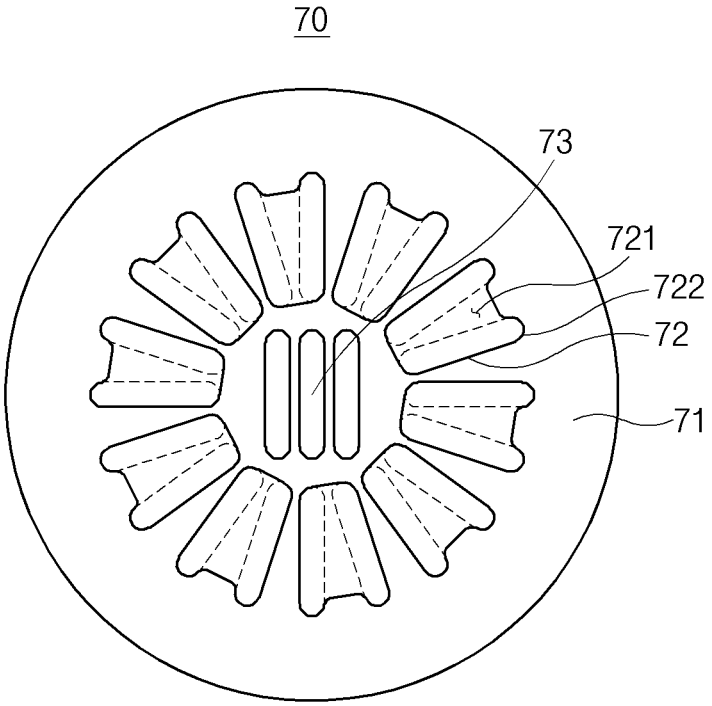
FIG. 13 is a plan view of a main diaphragm of a shell-and-tube type heat exchanger according to a second embodiment of the present disclosure.

FIG. 13 is a plan view of a main diaphragm of a shell-and-tube type heat exchanger according to a second embodiment of the present disclosure.

To support a radially inward or outward distal end of at least one of flues 30 passing through a wide through-hole, the wide through-hole of the main diaphragm 70 may be formed to surround the periphery of the inward or outward distal end independently of the other flues 30. Although FIG. 13 illustrates an example that stoppers 722 are formed to surround the peripheries of the outward distal ends of the flues 30, the stoppers may be identically applied to the inward distal ends.

The shapes of the wide through-holes of FIGS. 6 to 8 are not formed such that stoppers or grooves are present such that the main diaphragms 50, 80, and 90 support the flues 30. However, when wide through-holes are formed for the through-holes 52, 82, and 92, which have been described in the modified examples of the first embodiment illustrated in FIGS. 6 to 8, in a form surrounding radial distal ends of some of the flues 30 passing through the wide through-holes as in this embodiment, the flues 30 may be supported by stoppers of the wide through-holes surrounding the distal ends, and the main diaphragms 50, 80, and 90 may also be supported by the flues 30 so as not to rotate.

Hereinabove, even though all of the components are coupled into one body or operate in a combined state in the description of the above-mentioned embodiments of the present disclosure, the present disclosure is not limited to these embodiments. That is, all of the components may operate in one or more selective combination within the range of the purpose of the present disclosure. It should be also understood that the terms of "include", "comprise" or "have" in the specification are "open type" expressions just to say that the corresponding components exist and, unless specifically described to the contrary, do not exclude but may include additional components. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

The invention claimed is:

1. A shell-and-tube type heat exchanger comprising:

an outer container in a cylindrical shape, wherein openings are formed at opposite ends of the outer container, an empty space connected with the openings at the opposite ends is provided in the outer container, an inlet through which heating water is introduced into the empty space is provided at one end side of the outer container, and an outlet through which the heating water is discharged from the empty space is provided at an opposite end side of the outer container;

a lower tube plate configured to cover the opening at the one end side of the outer container;

an upper tube plate in a cylindrical shape, the upper tube plate being configured to cover the opening at the opposite end side of the outer container and provide an interior space in which a heat source configured to heat the heating water is located;

a plurality of flues configured to guide combustion gas generated by the heat source from the upper tube plate to the outside of the lower tube plate;

a main diaphragm in a circular plate shape, the main diaphragm being disposed between the lower tube plate and the upper tube plate across a reference direction that is a direction toward the opposite end side from the one end side of the outer container, wherein a plurality of through-holes through which the flues pass are formed in the main diaphragm;

a first diaphragm disposed between the lower tube plate and the main diaphragm across the reference direction, wherein the first diaphragm has a plurality of through-holes through which the flues individually pass and has, in the center, a central hole formed through the first diaphragm to provide a flow passage through which the heating water passes; and a second diaphragm disposed between the main diaphragm and the upper tube across the reference direction, wherein the second diaphragm has a plurality of through-holes through which the flues individually pass and has, in the center, a central hole formed through the second diaphragm to provide a flow passage through which the heating water passes, wherein at least some of the through-holes are wide through-holes, each of which is a single hole through which two or more flues among the flues pass together, and;

wherein the main diaphragm, the first diaphragm and the second diaphragm are tightly coupled to an inner circumferential surface of the outer container so as not to allow for passage of the heating water between outer circumferential surfaces of the main diaphragm, the first diaphragm and the second diaphragm and the inner circumferential surface of the outer container, such that the heating water flows along a path passing through the central hole of the first diaphragm, the wide through-holes of the main diaphragm around the flues surrounded by the wide through-holes and the central hole of the second diaphragm.

2. The shell-and-tube type heat exchanger of claim 1, wherein the main diaphragm allows the heating water introduced into the empty space of the outer container to pass through the main diaphragm along the reference direction via an empty space between two adjacent flues among the flues passing through the wide through-hole.

3. The shell-and-tube type heat exchanger of claim 1, wherein the wide through-hole is formed to be a single hole configured to surround two flues located at the outermost position with respect to a circumferential direction among the flues passing through the wide through-hole, and a space defined between the two flues.

4. The shell-and-tube type heat exchanger of claim 1, wherein the wide through-hole is formed to be a single hole configured to surround a space defined by two flues located at the outermost position with respect to a circumferential direction among the flues passing through the wide through-hole, a line circumferentially connecting radially inward distal ends of the flues passing through the wide through-hole, and a line circumferentially connecting radially outward distal ends of the flues passing through the wide through-hole.

5. The shell-and-tube type heat exchanger of claim 1, wherein to support a radially inward or outward distal end of at least one of the flues passing through the wide through-hole, the wide through-hole surrounds a periphery of the distal end independently of the other flues.

6. The shell-and-tube type heat exchanger of claim 1, wherein the flues are radially disposed with respect to the center of the main diaphragm and are provided in a multiple of 2, and wherein each of the through-holes is a wide through-hole through which two adjacent flues pass together.

7. The shell-and-tube type heat exchanger of claim 1, wherein the flues are radially disposed with respect to the center of the main diaphragm and are provided in a multiple of 4, and wherein each of the through-holes is a wide through-hole through which four adjacent flues pass together.

8. The shell-and-tube type heat exchanger of claim 1, wherein the flues are radially disposed with respect to the center of the main diaphragm and are provided in a multiple of 5, wherein each of the through-holes is one of a first wide through-hole through which two adjacent flues pass together and a second wide through-hole through which three adjacent flues pass together, and wherein the first and second wide through-holes are alternately disposed along a circumferential direction.

9. The shell-and-tube type heat exchanger of claim 1, wherein each of the through-holes is a wide through-hole through which the same number of adjacent flues pass together.

10. The shell-and-tube type heat exchanger of claim 1, wherein a plurality of central through-holes are formed in the center of the main diaphragm to pass through the main diaphragm and extend in any radial direction of the main diaphragm, wherein the central through-holes are disposed to be spaced apart from each other in a direction perpendicular to the radial direction, and wherein the plurality of flues include some flues passing through each of the central through-holes.

11. The shell-and-tube type heat exchanger of claim 1, wherein the upper tube plate provides, between an outer circumferential surface of the upper tube plate and an inner circumferential surface of the outer container, a flow space in which the heating water flows, and wherein the outlet of the outer container is connected to the flow space.

* * * * *